US006003521A

United States Patent [19]

Huang

[11] Patent Number: 6,003,521

[45] Date of Patent: Dec. 21, 1999

[54] HAIR FASTENER

[76] Inventor: Chao-Hsiung Huang, No. 89, Lane 7, Hsimen Road, Sec. 4, Tainan, Taiwan

[21] Appl. No.: 09/364,567

[22] Filed: Jul. 30, 1999

[51] Int. Cl.[6] ..... A45D 8/12

[52] U.S. Cl. ..... 132/275; 132/277; 132/273

[58] Field of Search ..... 132/275, 277, 132/273, 267, 268, 212, 245, 246; 24/5, 103, 112, 567; 267/178

[56] References Cited

U.S. PATENT DOCUMENTS

| | | | |
|---|---|---|---|
| 666,860 | 1/1901 | Buzzacott | 132/275 |
| 1,039,910 | 10/1912 | Degenhardt | 132/275 |
| 2,996,295 | 8/1961 | Smith | 267/178 |
| 3,237,260 | 3/1966 | Kallman et al. | 24/567 |
| 3,283,970 | 11/1966 | Faulkner | 24/567 |
| 3,718,144 | 2/1973 | Jennis | 132/267 |

*Primary Examiner*—Gene Mancene
*Assistant Examiner*—Pedro Philogene
*Attorney, Agent, or Firm*—Pro-Techtor International Services

[57] ABSTRACT

A hair fastener, which includes a spring coil having two hook rings at two opposite ends, and two respectively ornaments fastened to the hook rings of the spring coil for pulling by hand to stretch the spring coil, enabling the spring coil to be secured to the hair.

2 Claims, 5 Drawing Sheets

HAIR FASTENER

BACKGROUND OF THE INVENTION

The present invention relates to a hair fastener for fastening the hair, and more particularly to such a hair fastener, which is comprised of a spring coil, and two ornaments detachably secured to two distal ends of the spring coil.

In order to keep the hair in good order or a particular design, hair dressing apparatus such as hair clips, hair pins, barrettes, hair rollers, wave clips, etc. may be used. FIGS. 1 and 2 show a hair clip for this purpose. This structure of hair clip is comprised of spring coil 3. The spring coil 3 comprises a coil body 4, a hook 32 formed integral with a first end of the coil body 4, and a curved retaining rod 31 formed integral with a second end of the coil body 4 remote from the hook 32 and extending toward the hook 32. When in use, the free end of the curved retaining rod 31 is fastened to the hook 32, enabling the hair clip to be firmly secured to the hair. This structure of hair clip has drawbacks as outlined hereinafter.

1. When the curved retaining rod 31 is permanently deformed or damaged, the hair clip becomes useless.

2. Because the gaps in the coil body 4 are not highly adjustable, the spring coil 3 cannot fit different requirements to fasten different amount of hair, and the spring coil 3 may slip from the hair when fastened to a small amount of hair.

3. When installed, the monotonous outer appearance of the hair clip does not causes a sense of beauty.

SUMMARY OF THE INVENTION

According to one aspect of the present invention, the hair fastener comprises a spring coil having two hook rings at two opposite ends, and two respectively ornaments fastened to the hook rings of the spring coil for pulling by hand to stretch the spring coil, enabling the spring coil to be secured to the hair. According to another aspect of the present invention, the ornaments are detachably fastened to the hook rings of the spring coil, therefore the user can replace the ornaments with different designs. According to still another aspect of the present invention, when the ornaments are pulled outwards in reversed directions, the spring coil is stretched and can be moved relative to the hair to the desired position. When the ornaments are released from the hand, the spring coil immediately returns to its former shape to hold down the hair.

DETAILED DESCRIPTION OF THE PREFERRED EMBODIMENT

Figure 1:
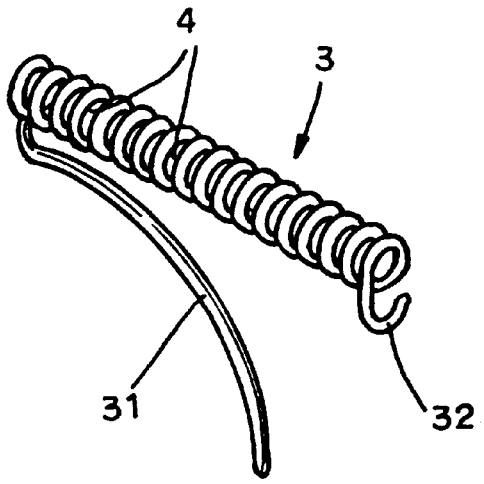
Fig.1 (Prior Art)
FIG. 1 is an extended view of a hair clip according to the prior art.
Figure 2:
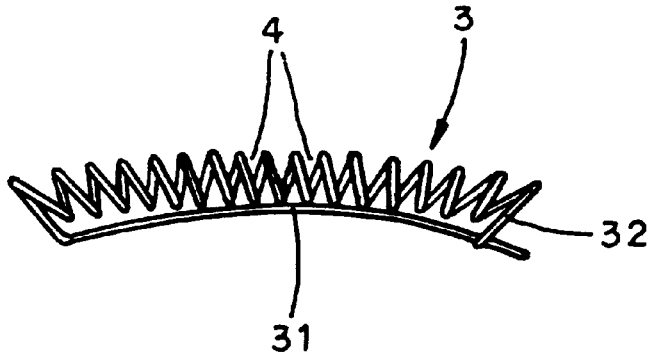
Fig.2 (Prior Art)
FIG. 2 shows the hair clip of FIG. 1 fastened up.
Figure 3:
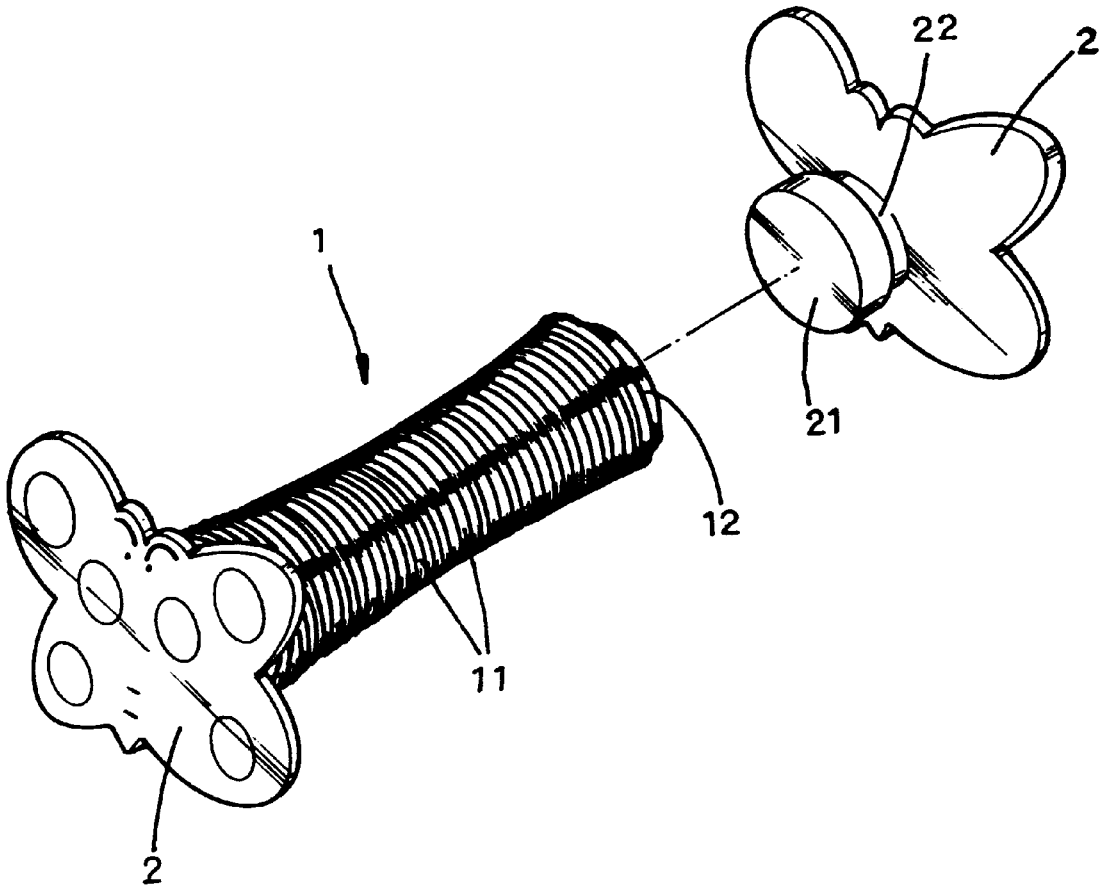
FIG. 3 is an exploded view of a hair fastener according to the present invention.
Figure 4:
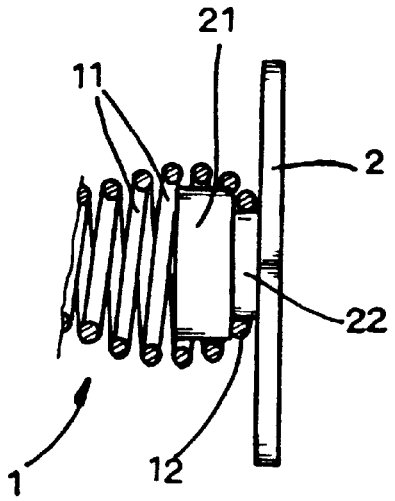
FIG. 4 is a sectional view of a part of the present invention, showing the hook ring at one end of the spring coil fastened to the neck of the coupling rod at one ornament.

Referring to FIGS. 3 and 4, a hair fastener is shown comprised of a spring coil 1, and two ornaments 2. The spring coil 1 comprises a coil body 11 formed of a number of turns 11 closely attached to one another, and two hook rings 12 at two opposite ends of the coil body 11. The ornaments 2 each have a coupling rod 21 at one side. The coupling rod 21 comprises a neck 22.

Referring to FIGS. 3 and 4 again, the hook rings 12 of the spring coil 1 are respectively hooked on to the neck 22 of the coupling rod 21 at each ornament 2, enabling the spring coil 1 to be connected between the ornaments 2. Because the diameter of the neck 22 is slightly greater than the inner diameter of the hook rings 12, the spring coil 1 can be stably connected between the ornaments 2.

Referring to Figures from 5 through 7, when the ornaments 2 are pulled outwards in reversed directions, the spring coil 1 is stretched, defining a spiral retaining space A for securing the hair. After the spring coil 1 has been stretched, the device is attached to the hair, enabling the hair to be engaged into the spiral retaining space a, and then the hands are released from the ornaments 2, enabling the spring coil 1 to return to its former shape and, to hold down the hair.

Figure 8:
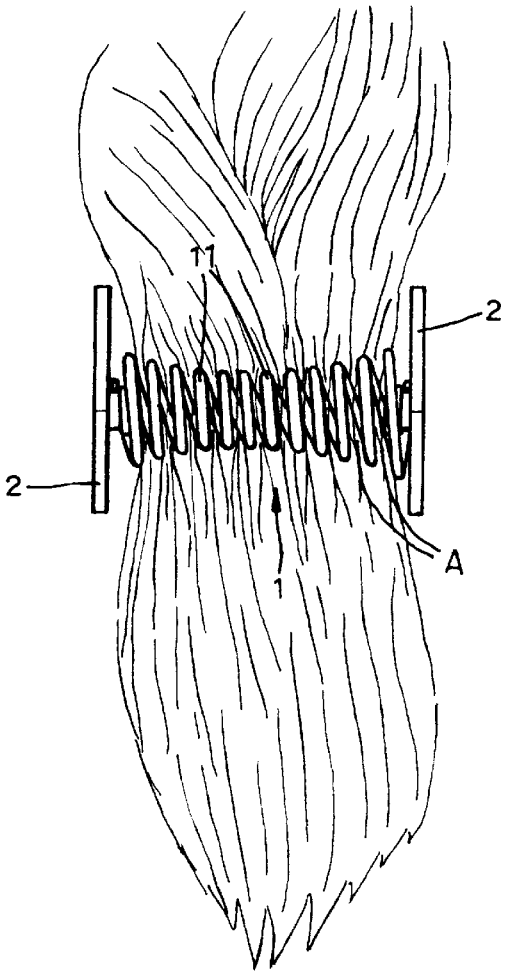
FIG. 8 shows another application example of the present invention.
Figure 7:
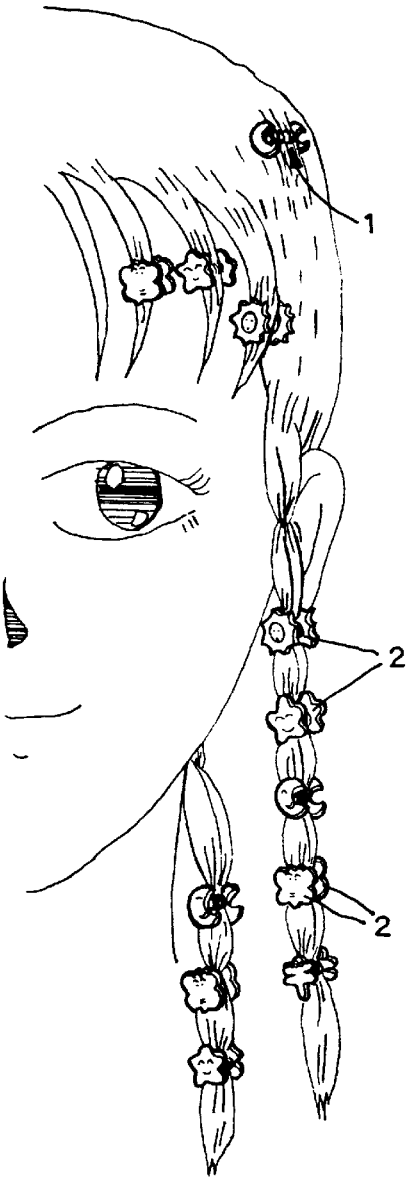
FIG. 7 shows an application example of the present invention.

Referring to FIG. 8 and FIG. 7 again, the hair fastener hair may be provided in different sizes for fastening different parts of the hair.

Figure 9:
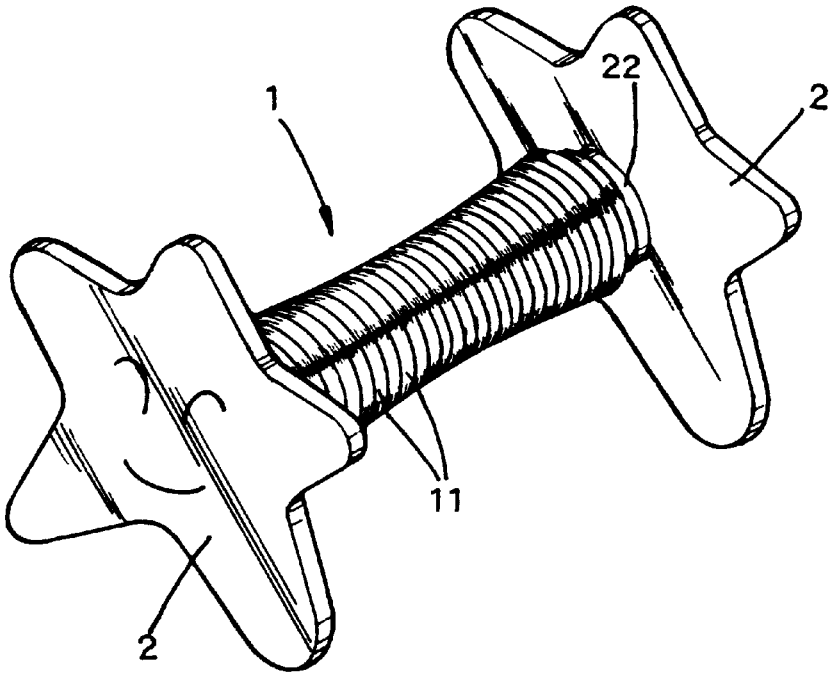
FIG. 9 shows different designs of ornaments fastened to the spring coil according to the present invention.
Figure 5:
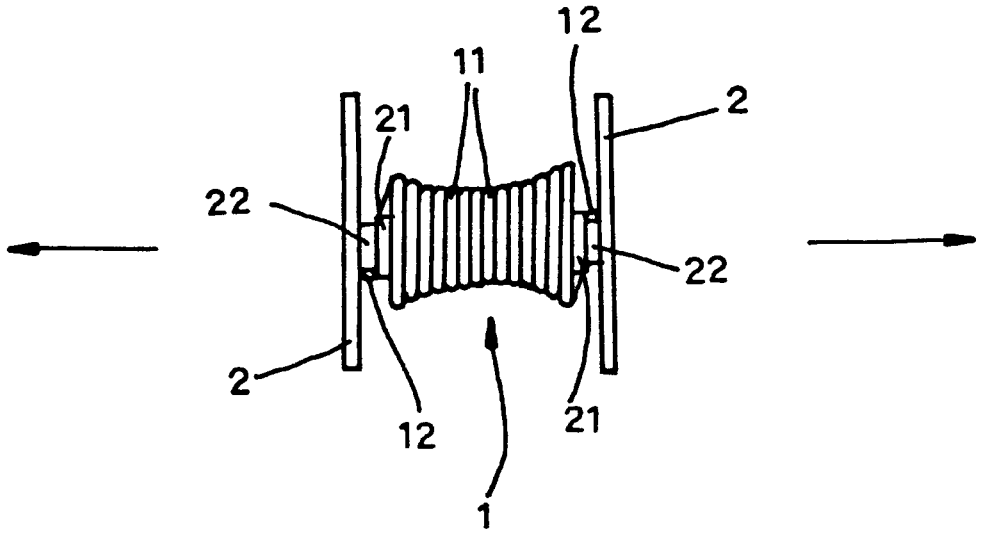
FIG. 5 shows the hair fastener released according to the present invention.
Figure 6:
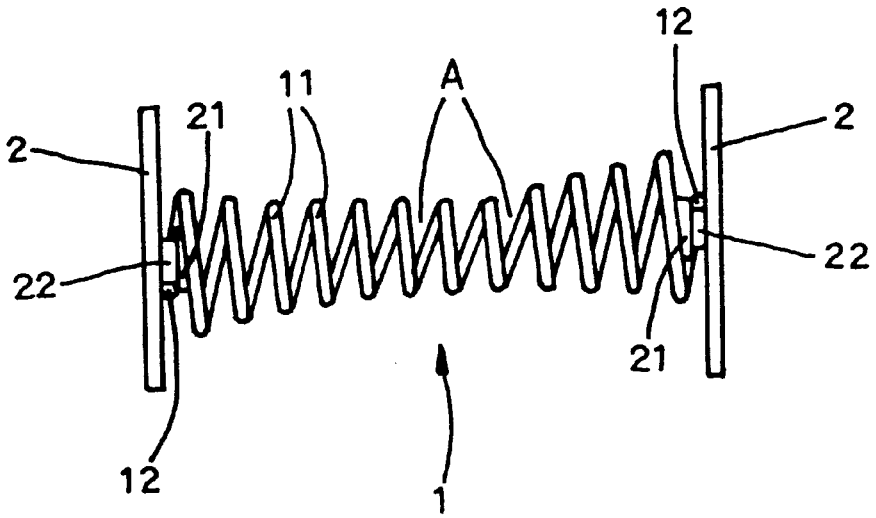
FIG. 6 shows the hair fastener stretched according to the present invention.

Referring to FIG. 9, when one ornament 2 is damaged, the damaged ornament 2 can be conveniently disconnected from the corresponding hook ring 12 for a replacement. If desired, ornaments 2 of different designs may be alternatively changed.

It is to be understood that the drawings are designed for purposes of illustration only, and are not intended for use as a definition of the limits and scope of the invention disclosed.

What the invention claimed is:

1. A hair fastener comprising a spring coil and two ornaments fastened to two distal ends of said spring coil, wherein said ornaments each have a coupling rod at one side, said coupling rod having a neck; said spring coil comprises two hook rings extended from two distal ends thereof and respectively hooked on the neck at the coupling rod at each of said ornaments.

2. The hair fastener of claim 1 wherein the hook rings of said spring coil have a diameter greater than the diameter of the neck of the coupling rod at each of said ornaments.

* * * * *